US005738349A

United States Patent [19]

Shirasaki

[11] Patent Number: 5,738,349

[45] Date of Patent: Apr. 14, 1998

[54] DEVICE FOR CONVEYING SHEET MEMBERS

[75] Inventor: Seiichi Shirasaki, Osaka, Japan

[73] Assignee: Mita Industrial Co., Ltd., Osaka, Japan

[21] Appl. No.: 534,320

[22] Filed: Sep. 27, 1995

[30] Foreign Application Priority Data

Sep. 30, 1994 [JP] Japan ..... 6-238217

[51] Int. Cl.[6] ..... B65H 9/04

[52] U.S. Cl. ..... 271/242; 271/265.01; 271/266

[58] Field of Search ..... 271/242, 265.01, 271/266

[56] References Cited

U.S. PATENT DOCUMENTS

| | | | |
|---|---|---|---|
| 4,678,178 | 7/1987 | Akiyama et al. | 271/266 |
| 4,936,567 | 6/1990 | Fukui | 271/266 |
| 5,022,642 | 6/1991 | Hasegawa et al. | 271/242 |
| 5,221,949 | 6/1993 | Miyamoto | 271/266 |
| 5,222,724 | 6/1993 | Hirano et al. | 271/242 |
| 5,222,728 | 6/1993 | Takahashi . | |
| 5,246,224 | 9/1993 | Matsumo et al. | 271/242 |
| 5,277,415 | 1/1994 | Kinoshita et al. . | |
| 5,355,206 | 10/1994 | Maruyama et al. | 271/242 |
| 5,415,387 | 5/1995 | Suzuki | 271/242 |
| 5,482,265 | 1/1996 | Nakazato et al. | 271/242 |
| 5,543,909 | 8/1996 | Quesnel | 271/242 |

FOREIGN PATENT DOCUMENTS

| | | |
|---|---|---|
| 204227 | 5/1986 | European Pat. Off. . |
| 477780 | 9/1991 | European Pat. Off. . |
| 4330405 | 7/1994 | Germany . |

*Primary Examiner*—William E. Terrell
*Assistant Examiner*—Khoi H. Tran
*Attorney, Agent, or Firm*—Antonelli, Terry, Stout, & Kraus, LLP

[57] ABSTRACT

A device for conveying sheet members, the device includes a pair of feed rollers, a pair of resist rollers disposed on the downstream side of the pair of feed rollers, and a drive control unite. The drive control unite starts driving the pair of feed rollers when the pair of resist rollers are not rotating in the primary conveyance interval and stops driving the pair of feed rollers after the front end of the sheet member conveyed by the action of the pair of feed rollers has come into contact with the nip of the pair of resist rollers and a loop has been formed in the sheet member between the pair of feed rollers and the pair of resist rollers. Then, the drive control unit, first, starts driving the pair of resist rollers in the secondary conveyance and starts driving the pair of feed rollers after a predetermined delay time has passed, so that the loop of the sheet member will not excessively increase and will not substantially extinguish before the rear end of the sheet member separates away from the pair of feed rollers.

8 Claims, 2 Drawing Sheets

DEVICE FOR CONVEYING SHEET MEMBERS

FIELD OF THE INVENTION

The present invention relates to a device for conveying sheet members used in image-forming machines such as copying machine, printing machine, facsimile machines and the like.

DESCRIPTION OF THE PRIOR ART

In the image-forming machines, such as a xerographic copying machine, a laser printer and a laser facsimile machines, as is well known, a toner image is formed on an electrostatic photosensitive material and is transferred onto a sheet member in a transfer zone. The electrostatic photosensitive material is usually disposed on the peripheral surface of a rotary drum. The sheet member, which may be a common paper, is moved by a device for conveying sheet members to pass through the transfer zone in synchronism with the movement of the electrostatic photosensitive material. The device for conveying sheet members comprises a pair of feed rollers, a pair of resist rollers disposed on the downstream side of the pair of feed rollers, the pair of resist rollers being apart therefrom by a predetermined conveyer passage length TL which is shorter than the length SL in the direction of conveyance of the sheet member that is to be conveyed, and a drive control means for controlling the drive of the pair of feed rollers and the pair of resist rollers. In such a device for conveying sheet members, a sheet member fed from a suitable feed means, such as a cassette-type feed mechanism, is primarily conveyed up to the pair of resist rollers and is then secondarily conveyed through the transfer zone. Specifically, in the primary conveyance, the pair of feed rollers starts driving when the pair of resist rollers are in a state not being driven, and the sheet member fed from the feed means is conveyed by the action of the pair of feed rollers and the front end of the sheet member comes into contact with the nip of the pair of resist rollers which are not rotated. Even after the front end of the sheet member is brought into contact with the pair of resist rollers, the pair of feed rollers continue to rotate for some period of time. Therefore, the front end of the sheet member is reliably pushed to the nip of the pair of resist rollers. Here, when the front end of the sheet member is not substantially at right angles with the direction of conveyance but is inclined, this inclination is corrected. Furthermore, a loop of a length RL is formed in the sheet member between the pair of resist rollers and the pair of feed rollers. The "length RL" of the loop formed in the sheet member stands for a length obtained by subtracting the conveyer passage length TL between the pair of feed rollers and the pair of resist rollers from the length SL of the sheet member that exists between the pair of feed rollers and the pair of resist rollers. In the secondary conveyance that is executed thereafter, however, the pair of resist rollers and the pair of feed rollers are driven substantially simultaneously in synchronism with the movement of the electrostatic photosensitive material and, hence, the sheet member is conveyed toward the transfer zone.

In the above-mentioned device for conveying sheet members, the length RL of the loop formed in the sheet member during the primary conveyance is defined by the conveyance length of the sheet member that has been conveyed by the pair of feed rollers from the moment at which the front end of the sheet member comes into contact with the nip of the pair of resist rollers that are not rotated. Therefore, the length RL of the loop formed in the sheet member undergoes a change due to the tolerance related to the point at which the rotation of the pair of feed rollers come to a halt and the production tolerance for diameters of the pair of feed rollers and the like. A variation in the length RL of the loop formed in the sheet member does not cause any problem, provided the front end of the sheet member is pushed sufficiently to the nip of the pair of resist rollers so that any inclination in the front end of the sheet member is reliably corrected, and provided the length RL of the loop formed in the sheet member is within an allowable range. There, however, exists the following problem concerning the loop formed in the sheet member that is secondarily conveyed in the conventional device for conveying sheet members. In starting the secondary conveyance, the pair of resist rollers are started rotating substantially simultaneously with the start of the pair of feed rollers. However, some difference can be formed between the moment when the pair of resist rollers start driving and the moment when the pair of feed rollers start driving, due to tolerance in the time required for completing the mechanical coupling of a clutch means disposed between the pair of resist rollers and an electric motor and a clutch means disposed between the pair of feed rollers and an electric motor. Further, the speed for conveying the sheet member by the pair of resist rollers is set to be substantially the same as the speed for conveying the sheet member by the pair of feed rollers. Due to tolerance in the production for diameters of the pair of resist rollers and the pair of feed rollers, however, some difference can be formed between the speed for conveying the sheet member by the pair of resist rollers and the speed for conveying the sheet member by the pair of feed rollers. As a consequence, when the pair of feed rollers are driven earlier than the pair of resist rollers and/or when the speed for conveying the sheet member by the pair of feed rollers is greater than the speed for conveying the sheet member by the pair of resist rollers, the length of loop of the sheet member between the pair of feed rollers and the pair of resist rollers is liable to increase in excess of the allowable range before the rear end of the sheet member separates away from the pair of feed rollers. When the length of the loop of the sheet member increases in great excess of the allowable range, the sheet member is folded or has wrinkles particularly in the case where it has a small stiffness or is placed under high-humidity conditions. To prevent the sheet member from being folded or wrinkled, it can be attempted to sufficiently increase the allowable amount of the length of the loop in the sheet member between the pair of feed rollers and the pair of resist rollers. For this purpose, however, a considerably large distance must be set between the pair of guide plates that define the sheet member conveyer passage between the pair of feed rollers and the pair of resist rollers, resulting in the occurrence of another problem in that the device for conveying sheet members becomes very bulky.

SUMMARY OF THE INVENTION

The object of the present invention, therefore, is to reliably prevent the loop of the sheet member from being excessively increased between the pair of feed rollers and the pair of resist rollers without causing another problem in that the device for conveying sheet members becomes very bulky.

Through keen study and experiment, the present inventors have discovered that the loop of a length RL formed in the sheet member during the primary conveyance does not excessively increase or does not substantially extinguish before the rear end of the sheet member separates away from the pair of feed rollers in the secondary conveyance when the pair of resist rollers is, first, driven and, then, the pair of feed rollers is driven after a predetermined delay time has passed in the secondary conveyance, and thus, the above-mentioned object can be accomplished.

That is, the present invention provides a device for conveying sheet members comprising a pair of feed rollers, a pair of resist rollers disposed on the downstream side of the pair of feed rollers, the pair of resist rollers being apart therefrom by a predetermined conveyer passage length TL which is shorter than the length SL of the sheet member in the direction of conveyance, and a drive control means for controlling the drive of the pair of feed rollers and the drive of the pair of resist rollers, wherein said drive control means starts driving the pair of feed rollers when the pair of resist rollers are in a state not driven in a primary conveyance interval, stops driving the pair of feed rollers after the front end of the sheet member conveyed by the action of the pair of feed rollers has come into contact with the nip of the pair of resist rollers and a loop of a length RL has been formed in the sheet member between the pair of feed rollers and the pair of resist rollers, and, then, starts driving the pair of resist rollers and a pair of feed rollers in the secondary conveyance interval, characterized in that the drive control means, first, starts driving the pair of resist rollers and, after a predetermined delay time has passed, starts driving the pair of feed rollers, so that the loop formed in the sheet member during the primary conveyance interval does not increase excessively and does not substantially extinguish before the rear end of the conveyed sheet member separates away from the pair of feed rollers.

It is desired to set the above-mentioned predetermined delay time so that the loop of the sheet member in the secondary conveyance interval will not increase in excess of the length RL of the loop that is formed in the sheet member during the primary conveyance interval. The predetermined delay time may, generally, be from about 5 to about 30 msec. It is desired that the length RL of the loop formed in the sheet member during the primary conveyance interval be from 0.1 to 0.2 times the predetermined conveyer passage length TL between the pair of feed rollers and the pair of resist rollers ($0.1 \times TL \leqq RL \leqq 0.2 \times TL$). It is desired that a detecting means for detecting the sheet member be disposed at a detecting position on the upstream side of the pair of resist rollers but on the downstream side of the pair of feed rollers, and that the above-mentioned drive control means stops driving the pair of feed rollers after a predetermined delay time has passed from the moment when the detecting means has detected the front end of the sheet member in the primary conveyance interval. It is further desired that the pair of feed rollers and the pair of resist rollers be drivably coupled to an electric motor via clutch means and that the control means control the operation of the clutch means in order to control the drive of the pair of feed rollers and of the pair of resist rollers.

In the device for conveying sheet members of the present invention, the pair of resist rollers are, first, driven in the secondary conveyance interval and, then, after a predetermined delay time has passed, the pair of feed rollers are driven. Therefore, the length of loop of the sheet member decreases at least in the initial stage of the secondary conveyance interval. When the speed for conveying the sheet member by the pair of feed rollers is greater than the speed for conveying the sheet member by the pair of resist rollers due to various tolerances in the production, the pair of feed rollers that are driven after the predetermined delay time has passed causes the length of loop of the sheet member to gradually increase. By suitably setting the predetermined delay time, however, it is possible to very easily prevent the loop length of the sheet member from excessively increasing before the rear end of the sheet member separates away from the pair of feed rollers. Desirably, it is possible to prevent the loop of the sheet member in the secondary conveyance interval from increasing in excess of the length RL of the loop that is formed in the sheet member during the primary conveyance interval. When the speed for conveying the sheet member by the pair of feed rollers is smaller than the speed for conveying the sheet member by the pair of resist rollers due to various tolerances in the production, the length of the loop of the sheet member in the secondary conveyance interval tends to be further decreased. By suitably setting the predetermined delay time, however, it is possible to very easily prevent the loop of the sheet member from extinguishing before the rear end of the sheet member separates away from the pair of feed rollers. When the loop of the sheet member extinguishes before the rear end of the sheet member separates away from the pair of feed rollers, the pair of feed rollers interfere with the conveyance of the sheet member by the pair of resist rollers, and precise synchronism is impaired between the electrostatic photosensitive material and the sheet member.

DETAILED DESCRIPTION OF THE PREFERRED EMBODIMENTS

The present invention will now be described in further detail with reference to the accompanying drawings which illustrate a preferred embodiment of a device for conveying sheet members constituted according to the invention.

Figure 1:
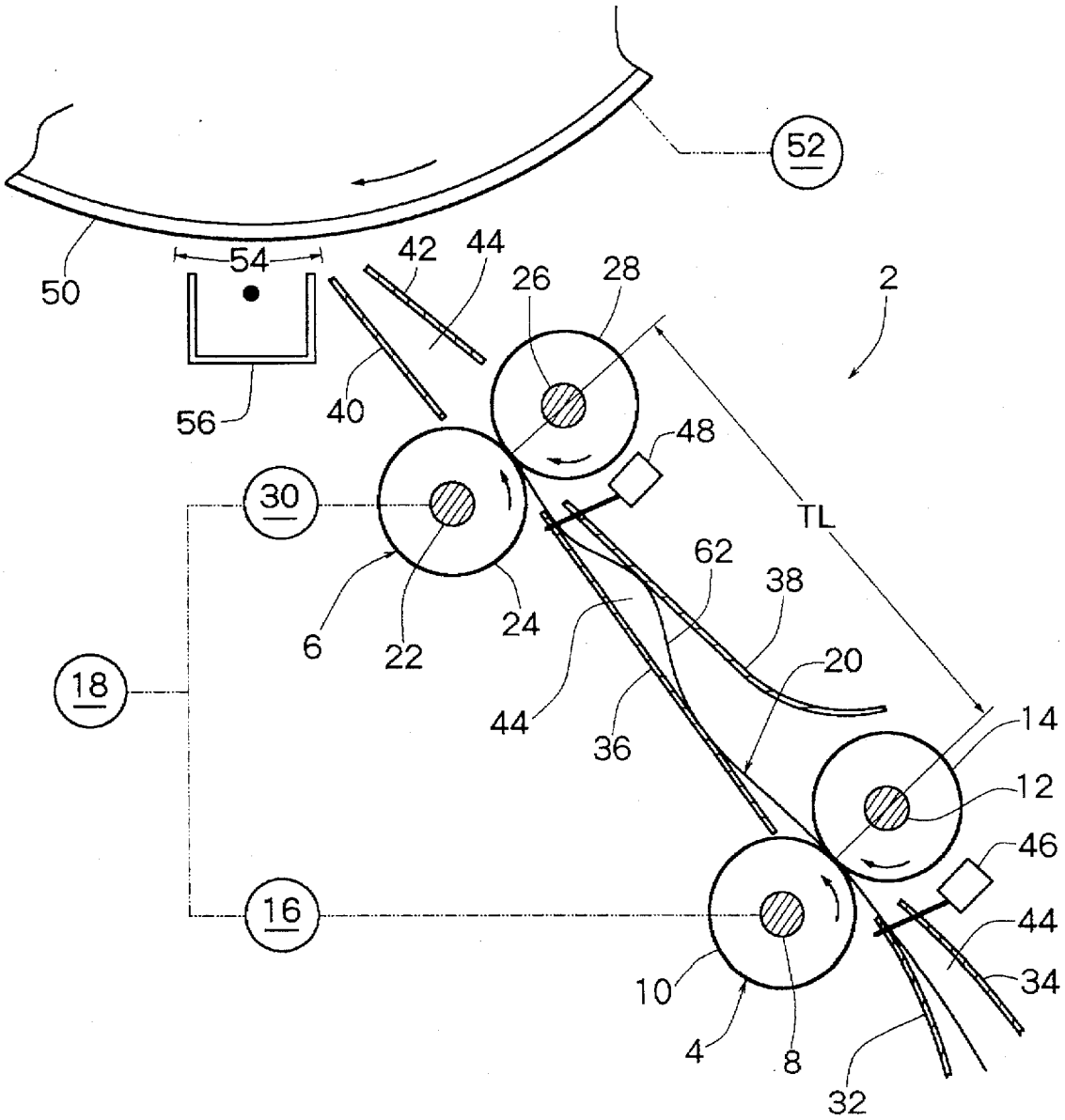
FIG. 1 is a sectional view illustrating a preferred embodiment of a device for conveying sheet members constituted according to the present invention, together with a portion of an image-forming machine which is equipped with this device for conveying the sheet members.

Referring to FIG. 1, a device generally designated at 2 for conveying sheet members includes a pair of feed rollers 4 and a pair of resist rollers 6.

The pair of feed rollers 4 are constituted by a driven roller 10 secured to a driven shaft 8 and a follower roller 14 secured to a follower shaft 12. The driven shaft 8 is rotatably mounted and extends in a direction perpendicular to the surface of the paper in FIG. 1. The follower shaft 12 is rotatably mounted and extends in a direction perpendicular to the surface of the paper in FIG. 1 and, hence, extends in parallel with the driven shaft 8. The follower shaft 12 is mounted to freely move in a direction to approach the driven shaft 8 and in a direction to separate away therefrom, and is resiliently urged toward the driven shaft 8 by a suitable resilient urging means (not shown). Therefore, the follower roller 14 secured to the follower shaft 12 is resiliently pressed to the driven roller 10 that is secured to the driven shaft 8. The driven roller 10 and the follower roller 12 can be made of a suitable synthetic rubber or a synthetic resin. As schematically shown in FIG. 1, the driven shaft 8 is connected to a rotary drive source 18, which may be an electric motor, via a clutch means 16, which may be an electromagnetic clutch. When the clutch means 16 is energized to the operating condition (coupled condition) in a state where the rotary drive source 18 is energized to rotate in a predetermined direction, the driven shaft 8 and the driven roller 10 secured thereto are rotated in a direction indicated by an arrow in FIG. 1, whereby the follower shaft 12 and the follower roller 14 secured thereto are rotated in a direction indicated by another arrow.

The pair of resist rollers 6 are disposed downstream of the pair of feed rollers 4, being apart from the pair of feed rollers 4 by a predetermined conveyer passage length TL. The conveyer passage length TL is set to be shorter than the length SL of a sheet member 20 in the direction of conveyance. The pair of resist rollers 6 is constituted by a driven roller 24 secured to a driven shaft 22 and a follower roller 28 secured to a follower shaft 26. The driven shaft 22 is rotatably mounted and extends in a direction perpendicular to the surface of the paper in FIG. 1. The follower shaft 26 is rotatably mounted, too, and extends in a direction perpendicular to the surface of the paper in FIG. 1, i.e., extends in parallel with the driven shaft 22. The follower shaft 26 is mounted to freely move in a direction to approach the driven shaft 22 and in a direction to separate away therefrom, and is resiliently urged toward the driven shaft 22 by a suitable resilient urging means (not shown). Therefore, the follower roller 28 secured to the follower shaft 26 is resiliently pressed onto the driven roller 24 that is secured to the driven shaft 22. The driven roller 24 and the follower roller 28 can be made of a suitable synthetic rubber or a synthetic resin. As schematically shown in FIG. 1, the driven shaft 22 is connected to the rotary drive source 18 via a clutch means 30, which may be an electromagnetic clutch. When the clutch means 30 is energized to the operating condition (coupled condition) in a state where the rotary drive source 18 is energized to rotate in a predetermined direction, the driven shaft 22 and the driven roller 24 secured thereto are rotated in a direction indicated by an arrow in FIG. 1, whereby the follower shaft 26 and the follower roller 28 secured thereto are rotated in a direction indicated by another arrow.

With further reference to FIG. 1, guide plates 32 and 34 (FIG. 1 illustrates the downstream portion thereof only) are disposed on the upstream side of the pair of feed rollers 4, guide plates 36 and 38 are disposed between the pair of feed rollers 4 and the pair of resist rollers 6, and guide plates 40 and 42 are disposed on the downstream side of the pair of resist rollers 6. These guide plates 32, 34, 36, 38, 40 and 42 define a conveyer passage 44 for the sheet member 20. Specifically, the guide plates 32 and 34 define the conveyer passage 44 therebetween on the upstream side of the pair of feed rollers 4, the guide plates 36 and 38 define the conveyer passage 44 therebetween between the pair of feed rollers 4 and the pair of resist rollers 6, and the guide plates 40 and 42 define the conveyer passage 44 therebetween on the downstream side of the pair of resist rollers 6.

Detecting means 46 and 48 are disposed in the device 2 for conveying sheet members. At a detecting position just on the upstream side of the pair of feed rollers 4, the detecting means 46 detects the sheet member 20 that is conveyed through the conveyer passage 44 defined between the guide plates 32 and 34. At a detecting position on the downstream side of the pair of feed rollers 4 but on the upstream side of the pair of resist rollers 6 and, preferably, at a detecting position just on the upstream side of the pair of resist rollers 6, the detecting means 48 detects the sheet member 20 that is conveyed through the conveyer passage 44 defined between the guide plates 36 and 38. The detecting means 46 and 48 can be constituted by microswitches that have detect arms protruding at detecting positions. Alternatively, the detecting means 46 and 48 may be constituted by switches of any other suitable form, such as transmission-type or reflection-type photoelectric switches.

With further reference to FIG. 1, the device 2 for conveying sheet members is mounted on an image-forming machine such as electrostatic copying machine which includes a rotary drum 50 (FIG. 1 illustrates only part of the rotary drum 50). An electrostatic photosensitive material is disposed on the peripheral surface of the rotary drum 50 which is rotatably mounted over the guide plates 40, 42 of the device 2 for conveying sheet members. The rotary drum 50 is connected to a rotary drive source 52, which may be an electric motor and is rotated in a direction indicated by an arrow in FIG. 1. As the rotary drum 50 rotates in a direction indicated by the arrow, the electrostatic photosensitive material disposed on the peripheral surface thereof moves through an electrostatic latent image-forming zone, a developing zone, a transfer zone 54 and a cleaning zone successively (FIG. 1 illustrates the transfer zone 54 only). In the electrostatic latent image-forming zone, an electrostatic latent image is formed on the electrostatic photosensitive material in a manner which is widely known, and the electrostatic latent image is developed into a toner image in the developing zone. In the transfer zone 54, a corona discharger 56 for transfer is disposed opposite the rotary drum 50. The sheet member 20 conveyed by the device 2 for conveying sheet members is brought into intimate contact with the peripheral surface of the rotary drum 50 in the transfer zone 54, a corona discharge of a predetermined polarity is applied to the back surface of the sheet member 20 from the corona discharger 56 for transfer and, thus, the toner image on the electrostatic photosensitive material is transferred onto the sheet member 20. The sheet member 20 to which the toner image is transferred is peeled off the peripheral surface of the rotary drum 50 and is fed to a fixing means (not shown) where the toner image is fixed onto the sheet member 20. In the above-mentioned cleaning zone, the toner remaining on the electrostatic photosensitive material after the transfer operation is removed.

Mechanical constitutions of the device 2 for conveying sheet members shown in FIG. 1 and of the image-forming machine equipped with this device 2, are ones which are widely known, and serve as typical examples to which the present invention can be adapted. Therefore, their details are not described in this specification.

Figure 2:
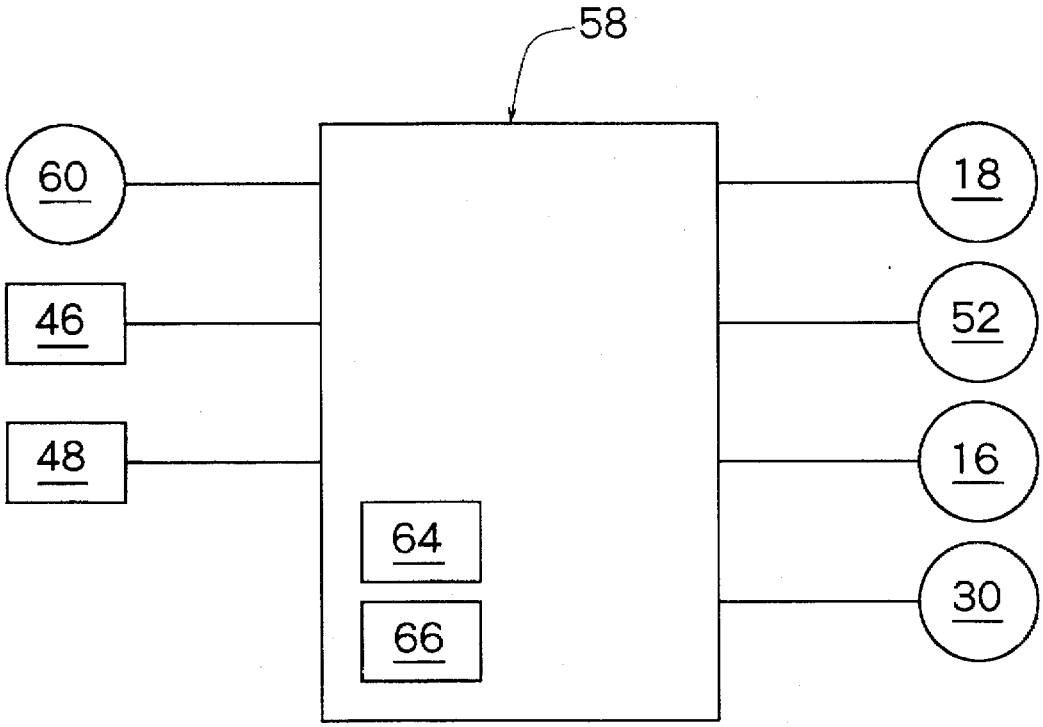
FIG. 2 is a schematic block diagram illustrating elements related to control operations of the device for conveying sheet members of FIG. 1.

With reference to FIG. 1 together with FIG. 2, a control means 58 that can be constituted by a microcomputer is disposed in the image-forming machine which is equipped with the device 2 for conveying sheet members, and operations of the rotary drive sources 18, 52 and clutch means 16, 30 are controlled by the control means 58 (accordingly, the control means 58 constitutes means for controlling the device 2 that conveys sheet members). Described below is the operation of the image-forming machine and, particularly, of the device 2 for conveying sheet members mounted thereon. As a start switch 60 (FIG. 2) disposed on the image-forming machine is closed by hand, the rotary drive sources 18 and 52 are energized, whereby the rotary drum 50 rotates in a direction indicated by an arrow in FIG. 1 to start the steps for forming an image including the above-mentioned process of electrostatic latent image formation, developing, transfer, fixing and cleaning. Primary conveyance of the sheet member 20 is started, and the sheet member 20, which may be a common paper, is fed to the device 2 for conveying sheet members from a sheet member feed mechanism (not shown) of the cassette type or of any other suitable form. The sheet member 20 enters into the conveyer passage 44 defined between the guide plates 32 and 34, and the detecting means 46 detects the front end of the sheet member 20. Then, the clutch means 16 is energized to cause the pair of feed rollers 4 to rotate in the direction indicated by the arrow. The sheet member 20 is introduced into the nip of the pair of feed rollers 4 that are rotating, and is continuously conveyed toward the downstream side by the action of the pair of feed rollers 4.

As the sheet member 20 is continuously conveyed by the action of the pair of feed rollers 4, the detecting means 48 detects the front end of the sheet member 20. Then, the front end of the sheet member 20 is brought into contact with the nip of the pair of resist rollers 6 which are of not rotating. Even thereafter, the pair of feed rollers 4 continue to rotate and, hence, the front end of the sheet member 20 is pushed onto the nip of the pair of resist rollers 6 which are not rotating. Therefore, in case the front end of the sheet member 20 is not fully precisely at right angels with the direction of conveyance but is inclined, such inclination is properly corrected. Since the pair of feed rollers 4 continue to convey the sheet member 20 in a state where the sheet member 20 is prevented from advancing by the pair of resist rollers 6 that are not rotating, a loop 62 is formed in the sheet member 20 between the pair of feed rollers 4 and the pair of resist rollers 6 as shown in FIG. 1. As a delay timer 64 contained in the control means 58 counts a predetermined delay time DT1 from the moment when the front end of the sheet member 20 is detected by the detecting means 48, the clutch means 16 is de-energized, whereby the pair of feed rollers 4 cease to rotate, and the primary conveyance is finished. The delay time DT1 counted by the delay timer 64 is so set that the loop 62 formed in the sheet member 20 between the pair of feed rollers 4 and the pair of resist rollers 6 will have a suitable length RL. The delay time DT1 should be so set that the loop 62 of a suitable length RL is stably formed between the pair of feed rollers 4 and the pair of resist rollers 6 by taking into consideration the tolerance in the time that is required from when the clutch means 16 is electrically deenergized up to when the pair of feed rollers 4 virtually cease to rotate. It is generally desired that the length RL of the loop 62 formed in the sheet member 20 be from 0.1 to 0.2 times the predetermined conveyer passage length TL between the pair of feed rollers 4 and the pair Of resist rollers 6 ($0.1 \times TL \leqq RL \leqq 0.2 \times TL$). To form the loop 62 of such a length RL, the delay time DT1 should generally be set to be from about 60 to about 100 msec, though the time may vary depending upon the conveyer passage length TL between the pair of feed rollers 4 and the pair of resist rollers 6, the speed for conveying the sheet member 20 by the pair of feed rollers 4, and performances of the clutch means 16 that is used.

A suitable means, such as detecting means (not shown) for detecting the progress of light image irradiation onto the electrostatic photosensitive material, forms a secondary conveyance start signal in response, as desired, to the rotation of the rotary drum 50, and the secondary conveyance of the sheet member 20 is started in response to this signal. In the device 2 for conveying sheet members constituted according to the present invention, the pair of feed rollers 4 and the pair of resist rollers 6 are not rotated substantially simultaneously in the secondary conveyance interval but the clutch means 30 is, first, energized to rotate the pair of resist rollers 6. Then, as the delay timer 66 contained in the control means 58 counts a predetermined delay time DT2, the clutch means 16 is energized causing the pair of feed rollers 4 to rotate. Thus, the sheet member 20 is fed, as desired, to the transfer zone 54 in synchronism with the rotation of the rotary drum 50.

In the secondary conveyance interval, the pair of resist rollers 6 are, first, rotated, and, after the predetermined delay time DT2 has passed, the pair of feed rollers 4 are rotated. In the initial stage of the secondary conveyance (interval before the pair of feed rollers 4 are rotated), therefore, the length of the loop 62 formed in the sheet member 20, between the pair of feed rollers 4 and the pair of resist rollers 6, gradually decreases. The speed for conveying the sheet member 20 by the pair of feed rollers 4 is set to be substantially the same as the speed for conveying the sheet member 20 by the pair of resist rollers 6. After the pair of feed rollers 4 have started rotating, therefore, the length of the loop 62 formed in the sheet member 20 between the pair of feed rollers 4 and the pair of resist rollers 6 is, theoretically, maintained substantially constant until the rear end of the sheet member 20 separates away from the nip of the pair of feed rollers 4. In practice, however, there may exist a slight difference between the speed for conveying the sheet member 20 by the pair of feed rollers 4 and the speed for conveying the sheet member 20 by the pair of resist rollers 6 due to the production tolerance for outer diameters of the rollers 10, 14, 24 and 28. When the speed for conveying the sheet member 20 by the pair of feed rollers 4 is slower than the speed for conveying the sheet member 20 by the pair of resist rollers 6, the length of the loop 62 formed in the sheet member 20 tends to further decrease, even after the pair of feed rollers 4 are rotated. When the speed for conveying the sheet member 20 by the pair of feed rollers 4 is faster than the speed for conveying the sheet member 20 by the pair of resist rollers 6, on the other hand, the length of the loop 62 formed in the sheet member 20 tends to increase after the pair of feed rollers 4 has started rotating. According to the present invention, the delay time DT2 is set to be a suitable period of time so that the loop 62 formed in the sheet member 20 between the pair of feed rollers 4 and the pair of resist rollers 6 will not increase excessively and, preferably, will not exceed the length RL of the loop 62 formed in the sheet member 20 during the primary conveyance interval and will not be substantially extinguished during the period before the rear end of the sheet member 20 separates away from the pair of feed rollers 4. If described in further detail, when the length of the loop 62 that decreases in the initial stage of the secondary conveyance interval increases after the pair of feed rollers 4 are rotated, the length of the loop 62 is so set that it will not increase beyond the allowable range or, preferably, so that it will not exceed the length RL of the loop 62 formed in the primary conveyance interval (i.e., the final length FRL of the loop 62 at a moment when the rear end of the sheet member 20 separates away from the pair of feed rollers 4 is $0 < FRL \leqq RL$). When the length of the loop 62 that decreases in the initial stage of the secondary conveyance interval continues to decrease even after the pair of feed rollers 4 have started rotating, the length of the loop 62 formed in the primary conveyance interval is so set as the loop 62 will not be completely extinguished (i.e., the final length FRL at the moment when the rear end of the sheet member 20 separates away from the pair of feed rollers 4 is $0 < FRL < RL$). To satisfy such requirements, the delay time DT2 may, be, generally, be set to be from about 5 to about 30 msec, though it may vary depending upon the conveyer passage length TL between the pair of feed rollers 4 and the pair of resist rollers 6, upon the speed for conveying the sheet member 20 by the pair of feed rollers 4, and upon the speed for conveying the sheet member 20 by the pair of resist rollers 6. Thus, the device 2 for conveying sheet members constituted according to the present invention makes it possible to reliably prevent the length of the loop 62 formed in the sheet member 20 from excessively increasing and, hence, possible to prevent the occurrence of folding or wrinkles in the sheet member 20. Moreover, the loop 62 of the sheet member 20 is prevented from extinguishing, making it possible to reliably prevent the occurrence of such an event that the conveyance of the sheet member by the pair of resist rollers 6 is interfered with by the pair of feed rollers 4.

EXAMPLE

An Example will now be described. Twenty devices for conveying the sheet members were assembled in a form as shown in FIG. 1. The devices for conveying the sheet members were all designed in the same manner; i.e.,

| | |
|---|---|
| Outer diameter of driven roller of the pair of feed rollers: | 17.85 mm |
| Peripheral speed of driven roller of the pair of feed rollers: | 250.9 mm/s |
| Outer diameter of driven roller of the pair of resist rollers: | 17.85 mm |
| Peripheral speed of driven roller of the pair of resist rollers: | 250.9 mm/s |
| Conveyer passage length between the pair of feed rollers and the pair of resist rollers: | 67.5 mm |
| Conveyer passage length between the position for detecting a sheet member just on the upstream side of the pair of resist rollers and the pair of resist rollers: | 13.6 mm |

and clutch means disposed between the pair of feed rollers and the rotary drive source and clutch means disposed between the pair of resist rollers and the rotary drive source, were both electromagnetic clutches placed in the market by Ogura Clutch Co. Ltd. in the trade name "MIC5N".

The delay time DT1 in the primary conveyance interval (time from when the sheet member is detected on the upstream side of the pair of resist rollers until when the clutch means of the pair of feed rollers is deenergized) was set to 84 msec, and the delay time DT2 in the secondary conveyance interval (time from when the clutch means of the pair of resist rollers is energized until when the clutch means of the pair of feed rollers is energized) was set to 16 msec.

In each of the twenty devices for conveying sheet members, the sheet members, which are common papers having a size A4, were subjected to the primary conveyance interval and to the secondary conveyance interval 100 times repetitively. The lengths of the loops formed in the sheet members during the primary conveyance interval were measured to be from 7.2 to 9.5 mm. Changes in the loops of the sheet members during the secondary conveyance interval were observed, and it was found that the loops of the sheet members did not increase in excess of the length of the loop formed in the primary conveyance and did not virtually extinguish.

What we claim is:

1. A device for conveying sheet member in a direction of conveyance, said device comprising means for introducing a sheet member having a length SL, a pair of feed rollers, a pair of resist rollers disposed on the downstream side of the pair of feed rollers by a predetermined conveyer passage length TL which is shorter than the length SL of the sheet member in the direction of conveyance, and drive control means for controlling driving of the pair of feed rollers and the pair of resist rollers, wherein said drive control means starts driving the pair of feed rollers when the pair of resist rollers are not driven, in a primary conveyance interval, stops driving the pair of feed rollers to stop rotation of the pair of feed rollers after the front end of the sheet member conveyed by the action of the pair of feed rollers has come into contact with the nip of the pair of resist rollers and a loop of a length RL has been formed in the conveyed sheet member between the pair of feed rollers and the pair of resist rollers, and then starts driving the pair of resist rollers and the pair of feed rollers in a secondary conveyance interval, and wherein during the secondary conveyance interval said drive control means first starts driving the pair of resist rollers and, after a predetermined delay time has passed, starts driving the pair of feed rollers, the predetermined delay time being such that the loop formed in the conveyed sheet member during the primary conveyance interval does not increase excessively does not substantially extinguish before the rear end of the sheet member separates from the pair of feed rollers.

2. A device for conveying sheet members according to claim 1, wherein during the secondary conveyance interval, the loop in the conveyed sheet member does not increase to a length in excess of the length RL of the loop as formed in the conveyed sheet member during the primary conveyance interval.

3. A device for conveying sheet members according to claim 1, wherein the predetermined delay time is from 5 to 30 msec.

4. A device for conveying sheet members according to claim 1, wherein the length RL of the loop formed in the conveyance sheet member during the primary conveyance interval is from 0.1 to 0.2 times the predetermined conveyer passage length TL.

5. A device for conveying sheet members according to claim 1, further comprising detecting means for detecting a sheet member at a detecting position on the upstream side of the pair of resist rollers but on the downstream side of the pair of feed rollers, and wherein the drive control means stops driving the pair of feed rollers after a second predetermined delay time has passed from when the front end of the conveyed sheet member is detected by the detecting means in the primary conveyance interval.

6. A device for conveying sheet members according to claim 1, further comprising an electric motor, and clutch means drivingly coupling the electric motor to the pair of feed rollers and the pair of resist rollers, and wherein the control means controls the operation of the clutch means, thereby to control the rotation of the pair of feed rollers and the rotation of the pair of resist rollers.

7. A device for conveying sheet members in a direction of conveyance, said device comprising means for introducing a sheet member having a length SL, a pair of feed rollers, a pair of resist rollers disposed downstream of the pair of feed rollers in the direction of conveyance by a predetermined conveyer passage length TL which is shorter than the length SL, means for starting driving of the pair of feed rollers when the pair of resist rollers are not driven in a primary conveyance interval, means for stopping driving of the pair of feed rollers to stop rotation of the pair of feed rollers after the front end of the conveyed sheet member has come into contact with the nip of the pair of resist rollers and a loop of a length RL has been formed in the conveyed sheet member between the pair of feed rollers and the pair of resist rollers, means for starting driving of the pair of resist rollers, and means responsive to passing of a predetermined delay time after starting of driving of the pair of resist rollers for again starting driving of the pair of feed rollers, the predetermined delay time being such that the loop formed in the conveyed sheet member during the primary conveyance interval does not increase excessively and does not substantially extinguish before the rear end of the conveyed sheet member separates from the pair of feed rollers, where TL<SL.

8. A method of conveying sheet members in a direction of conveyance, using a pair of feed rollers, a pair of resist rollers disposed downstream of the pair of feed rollers by a predetermined conveyer passage length TL which is shorter than the length SL, said method comprising the steps of introducing a sheet member having a length SL, starting driving the pair of feed rollers when the pair of resist rollers are not driven in a primary conveyance interval, stopping driving of the pair of feed rollers to stop rotation of the pair of feed rollers after the front end of the conveyed sheet member has come into contact with the nip of the pair of resist rollers and a loop of a length RL has been formed in the conveyed sheet member between the pair of feed rollers and the pair of resist rollers, starting driving of the pair of resist rollers and, after a predetermined delay time has passed after starting of driving of the pair, of resist rollers, again starting driving of the pair of feed rollers, the predetermined delay time being such that the loop formed in the conveyed sheet member during the primary conveyance interval does not increase excessively and does not substantially extinguish before the rear end of the conveyed sheet member separates away from the pair of feed rollers.

* * * * *